US010146159B1

(12) United States Patent
Okada

(10) Patent No.: US 10,146,159 B1
(45) Date of Patent: Dec. 4, 2018

(54) FIXING DEVICE AND IMAGE FORMING APPARATUS

(71) Applicant: KYOCERA Document Solutions Inc., Osaka (JP)

(72) Inventor: Seiji Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/981,220

(22) Filed: May 16, 2018

(30) Foreign Application Priority Data

Jun. 6, 2017 (JP) ..... 2017-111911

(51) Int. Cl.
*G03G 15/20* (2006.01)
*G03G 15/00* (2006.01)

(52) U.S. Cl.
CPC ..... *G03G 15/2028* (2013.01); *G03G 15/6573* (2013.01)

(58) Field of Classification Search
CPC ..... G03G 15/2028; G03G 15/2085; G03G 15/6573; G03G 2215/00417; G03G 15/6532
See application file for complete search history.

(56) References Cited

U.S. PATENT DOCUMENTS 4,168,902 A * 9/1979 Golz ..... B65H 29/56 399/399
4,951,936 A * 8/1990 Taniyama ..... G03G 15/6532 271/307
5,802,434 A * 9/1998 Takehara ..... G03G 15/2039 271/308
6,650,862 B2 11/2003 Nakano et al.
7,463,858 B2 * 12/2008 Shiokawa ..... G03G 15/2028 399/323
7,565,101 B2 * 7/2009 Yamanaka ..... G03G 15/2028 399/323

FOREIGN PATENT DOCUMENTS

JP 2002-357975 A 12/2002

* cited by examiner

*Primary Examiner* — David M. Gray
*Assistant Examiner* — Laura Roth
(74) *Attorney, Agent, or Firm* — Studebaker & Brackett PC

(57) ABSTRACT

A fixing device includes a fixingmember, a separation member, a movement mechanism, and a pressing member. The fixing member rotates around a rotation axis extended in a rotation axis direction and fixes a toner image on a recording medium. The separation member comes in contact with the fixing member and separates the recording medium from the fixing member. The movement mechanism moves the separation member in the rotation axis direction and within a movement area. The pressing member presses the separation member against the fixing member. A pressing load of the separation member against the fixing member in a case where the separation member is located at a central position of the movement area is lower than a pressing load of the separation member against the fixing member in a case where the separation member is located at both end positions of the movement area.

8 Claims, 8 Drawing Sheets

FIG. 6

| contact point | P1 | P2 | P3 | P4 |
|---|---|---|---|---|
| contact time for every one cycle (8 sec.) | 6 sec. | 5 sec. | 3 sec. | 1 sec. |
| contact time when target time (5000 sec.) elapses | 3750 sec. | 3125 sec. | 1875 sec. | 625 sec. |
| ratio to maximum contact time | 100% | 83% | 50% | 17% |

FIXING DEVICE AND IMAGE FORMING APPARATUS

INCORPORATION BY REFERENCE

This application is based on and claims the benefit of priority from Japanese patent application No. 2017-111911 filed on Jun. 6, 2017, which is incorporated by reference in its entirety.

BACKGROUND

The present disclosure relates to a fixing device and an image forming apparatus.

An electrographic image forming apparatus conventionally includes a fixing device that fixes a toner image on a recording medium. This fixing device, for example, includes a fixing member that fixes the toner image on the recording medium and a separation member that comes in contact with the fixing member and separates the recording medium from the fixing member.

In the aforementioned fixing device, in some cases, when the separation member continuously comes in contact with the same part of the fixing member, the fixing member is partially worn away by the separation member, which causes partial abrasion of the fixing member. When the partial abrasion of the fixing member occurs, the releasability of the fixing member is reduced, which may lead to occurrence of a phenomenon (so-called a toner offset) in which a toner is adhered to the fixing member. Then, there has been known a fixing device that includes a movement mechanism to move the separation member in a rotation axis direction of the fixing member.

SUMMARY

In accordance with an aspect of the present disclosure, a fixing device includes a fixing member, a separation member, a movement mechanism, and a pressing member. The fixing member rotates around a rotation axis extended in a rotation axis direction and fixes a toner image on a recording medium. The separation member comes in contact with the fixing member and separates the recording medium from the fixing member. The movement mechanism moves the separation member in the rotation axis direction and within a movement area. The pressing member presses the separation member against the fixing member. A pressing load of the separation member against the fixing member in a case where the separation member is located at a central position of the movement area is lower than a pressing load of the separation member against the fixing member in a case where the separation member is located at both end positions of the movement area.

In accordance with an aspect of the present disclosure, an image forming apparatus includes the fixing device.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 6 is a table illustrating a contact time of each separation claw and a fixing roller at each contact point in the fixing device according to the one embodiment of the present disclosure.

DETAILED DESCRIPTION

Hereinafter, an image forming apparatus 1 according to one embodiment of the present disclosure will be described.

Firstly, an entire structure of the image forming apparatus 1 will be described. The image forming apparatus 1 is a printer, for example. Arrows Fr, Rr, L, R, U, and Lo suitably shown in each figure respectively indicate a front side, a rear side, a left side, a right side, an upper side, and a lower side of the image forming apparatus 1.

Figure 1:
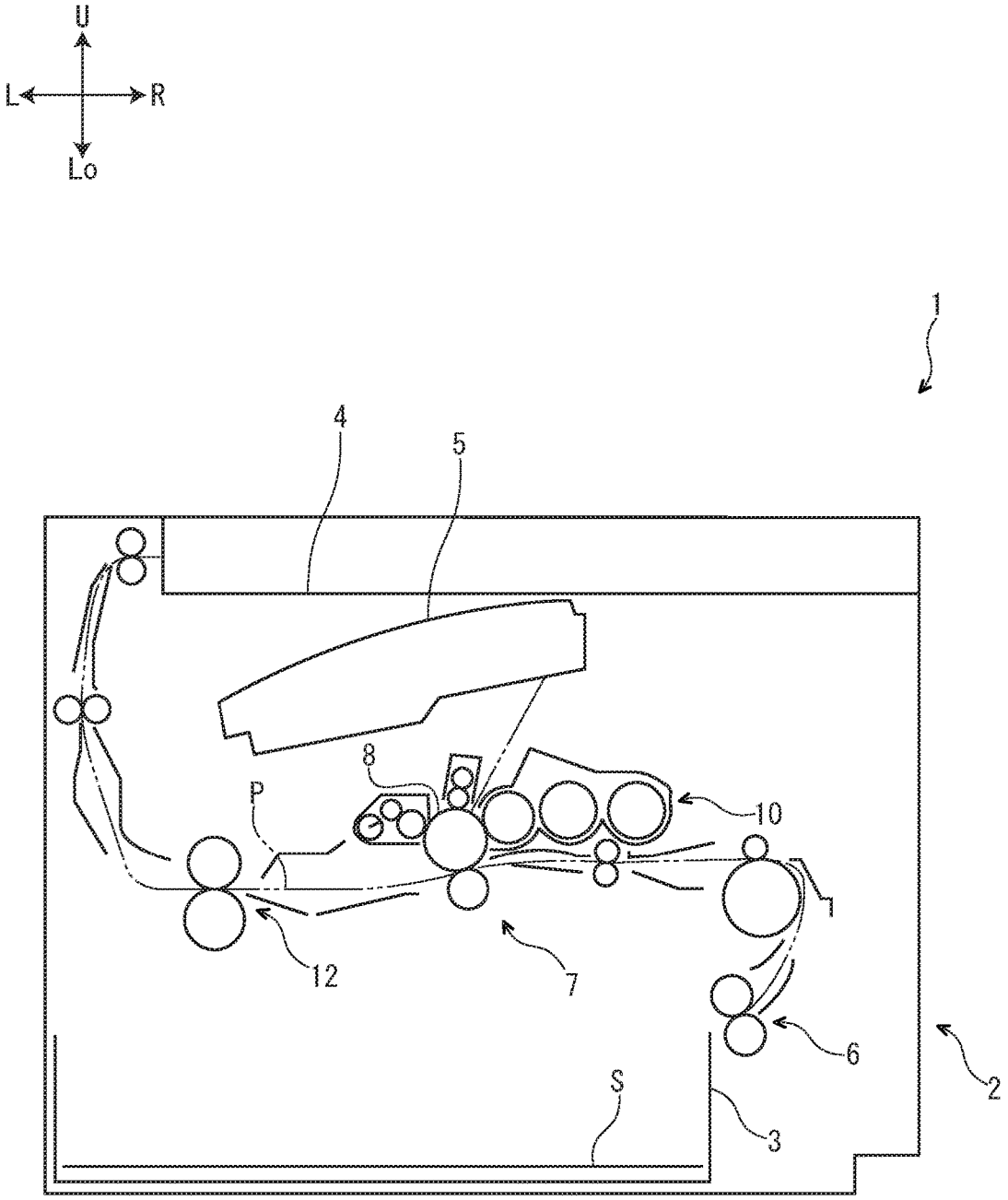
FIG. 1 is a schematic view of an image forming apparatus according to one embodiment of the present disclosure.

With reference to FIG. 1, the image forming apparatus 1 includes a box-shaped apparatus main body 2. In a lower portion of the apparatus main body 2, a sheet feeding cassette 3 storing a sheet S (an example of a recording medium) is stored. On an upper face of the apparatus main body 2, an ejected sheet tray 4 is provided. In an upper portion of the apparatus main body 2, an exposing device 5 is stored below the ejected sheet tray 4.

Inside the apparatus main body 2, a conveying path P for the sheet S is provided. At an upstream end portion of the conveying path P, a sheet feeding part 6 is provided. At a middle portion of the conveying path P, an image forming part 7 is provided. The image forming part 7 includes a photosensitive drum 8 and a developing device 10. At a downstream portion of the conveying path P, a fixing device 12 is provided.

Next, an operation of the image forming apparatus 1 having the above-mentioned configuration will be described.

Firstly, by laser light (refer to a two-dotted line in FIG. 1) from the exposing device 5, an electrostatic latent image is formed on the photosensitive drum 8. Next, the developing device 10 develops the electrostatic latent image on the photosensitive drum 8 to form a toner image. Thereby, an image forming operation is finished.

On the other hand, the sheet S fed from the sheet feeding cassette 3 by the sheet feeding part 6 is conveyed to the image forming part 7 at a timing corresponding to the above-mentioned image forming operation. At the image forming part 7, the above toner image is transferred on the sheet S from the photosensitive drum 8. The sheet S on which the toner image is transferred enters the fixing device 12. At the fixing device 12, the toner image is fixed on the sheet S . The sheet S on which the toner image is fixed is ejected on the ejected sheet tray 4 from a downstream end part of the conveying path P.

Next, the fixing device 12 will be further described. An arrow Y illustrated in FIG. 2 indicates a conveying direction of the sheet S in the fixing device 12. An arrow O suitably shown in each figure indicates an outside in the front-and-rear direction of the fixing device 12, and an arrow I suitably shown in each figure indicates an inside in the front-and-rear direction of the fixing device 12.

Figure 2:
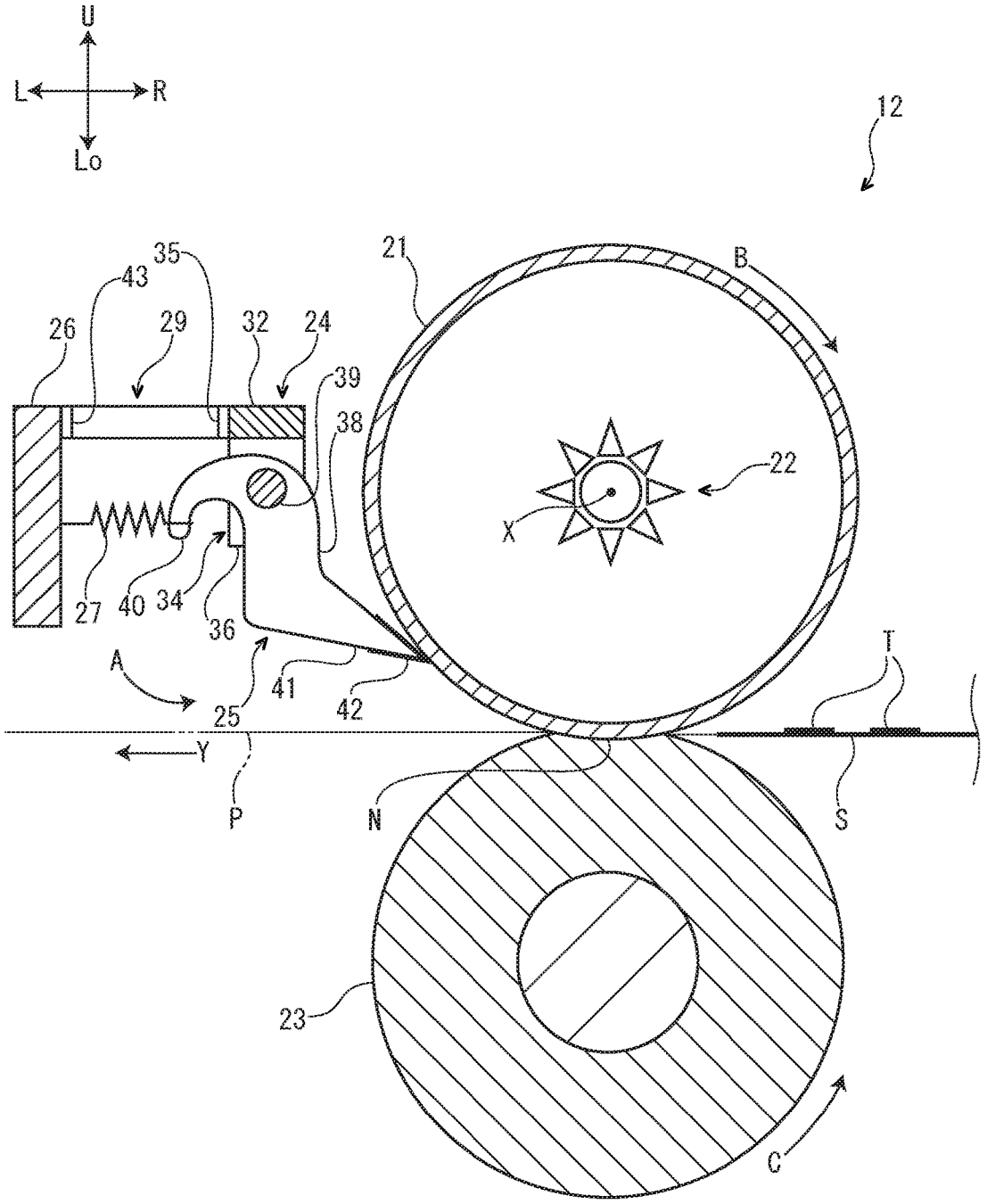
FIG. 2 is a sectional view of a fixing device according to the one embodiment of the present disclosure.
Figure 3:
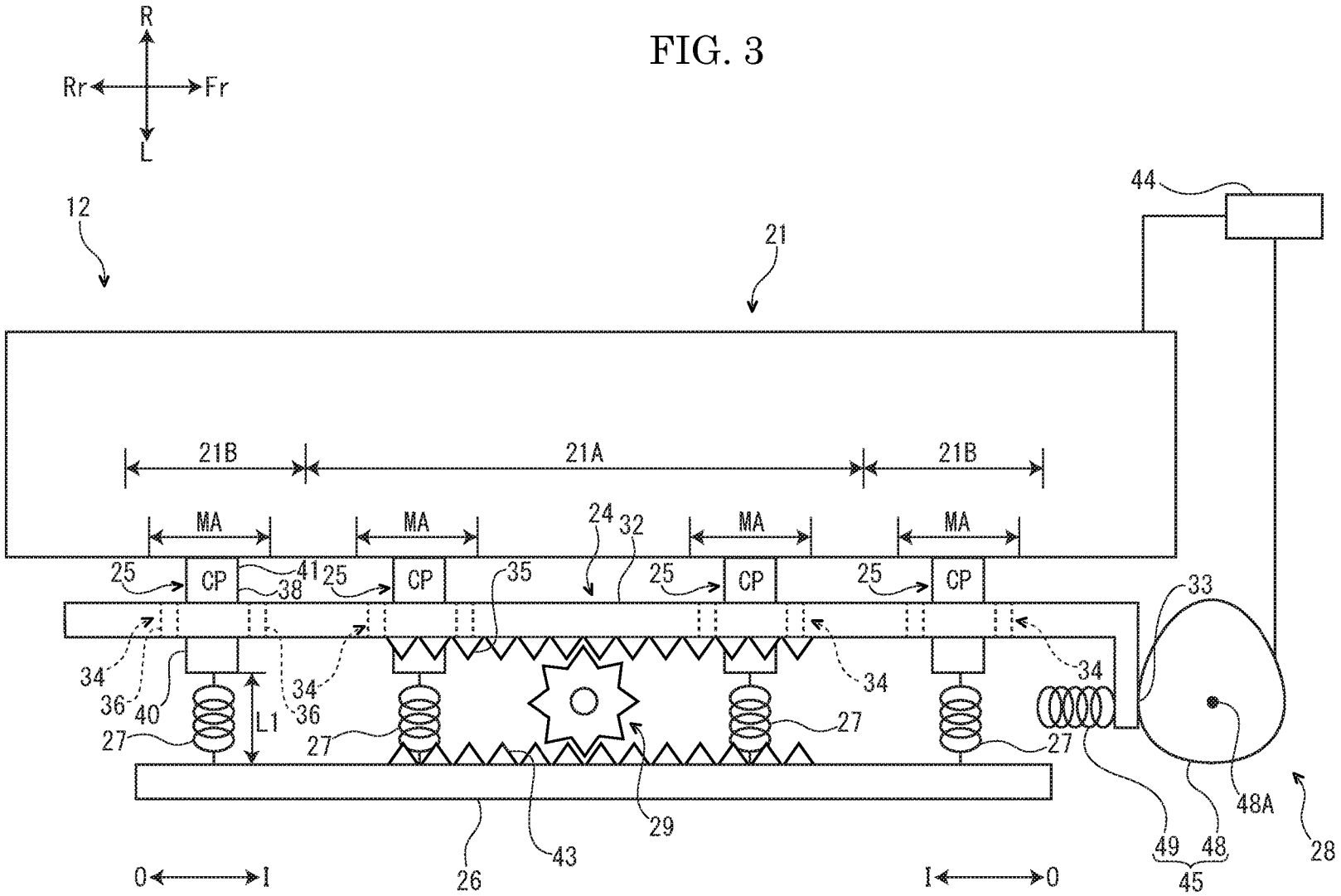
FIG. 3 is a plan view illustrating a state in which each separation claw is located at a central position of a movement area in the fixing device according to the one embodiment of the present disclosure.

With reference to FIGS. 2 and 3, the fixing device 12 includes a fixing roller 21 (one example of a fixing member), a heater 22 stored in the fixing roller 21, a pressing roller 23 provided on the lower side of the fixing roller 21, a holder 24 and four separation claws 25 (one example of a separation member) provided on the left side of the fixing roller 21, a mounting member 26 provided on the left side of the holder 24, four tension springs 27 (one example of a pressing member), each of which is interposed between each separation claw 25 and the mounting member 26, a movement mechanism 28 provided on the front side of the fixing roller 21, and a pinion gear 29 arranged between the holder 24 and the mounting member 26.

With reference to FIG. 2, the fixing roller 21 of the fixing device 12 is formed in a cylindrical shape and extended in the front-and-rear direction. The fixing roller 21 is rotatable around a rotation axis X extended along the front-and-rear direction. That is, in the present embodiment, the front-and-rear direction corresponds to the rotation axis direction of the fixing roller 21.

The fixing roller 21, for example, includes a cylindrical core and a release layer for covering the core. The core of the fixing roller 21, for example, is formed of metal such as aluminum and iron. The release layer of the fixing roller 21, for example, is formed of fluorine-containing resin such as Per Fluro Alkoxy (PFA).

With reference to FIG. 3, a central area 21A and a pair of end areas 21B provided on both outer sides in the front-and-rear direction of the central area 21A are formed on the outer circumferential face of the fixing roller 21. The central area 21A is an area through which both of a first-size sheet S (e.g., a longitudinal A5-size sheet S) and a second-size sheet S (e.g., a longitudinal A4-size sheet S) which is larger than the first-size sheet S pass. The pair of end areas 21B is an area through which the first-size sheet S does not pass but the second-size sheet S passes.

With reference to FIG. 2, the heater 22 of the fixing device 12, for example, is constituted by a halogen heater. The heater 22 is configured to generate heat when electric power is supplied to the heater 22 and heat the fixing roller 21.

The pressing roller 23 of the fixing device 12, for example, is formed in a cylindrical shape and extended along the front-and-rear direction. The pressing roller 23 is rotatable. The pressing roller 23 comes in contact with the fixing roller 21 under predetermined pressure, and a fixing nip N is formed between the fixing roller 21 and the pressing roller 23.

The pressing roller 23, for example, includes a cylindrical core, an elastic layer provided around this core, and a release layer for covering the elastic layer. The core of the pressing roller 23, for example, is formed of metal such as aluminum and iron. The elastic layer of the pressing roller 23, for example, is formed of an elastic material such as silicone rubber. The release layer of the pressing roller 23, for example, is formed of fluorine-containing resin such as Per Fluro Alkoxy (PFA).

With reference to FIGS. 2 and 3, the holder 24 of the fixing device 12 is movable in the front-and-rear direction. The holder 24 includes a base part 32 extended along the front-and-rear direction, a bent part 33 bent from the front end part of the base part 32 to the left side, and four guide parts 34 protruding downward from the lower face of the base part 32. A first rack gear 35 is provided on the left face of the base part 32. Each guide part 34 includes a pair of front and rear guide plates 36.

With reference to FIG. 2, each separation claw 25 of the fixing device 12 includes a main body 38, a pair of shafts 39 protruding from the upper part of the main body 38 to both front and rear outer sides (only the shaft 39 on the front side is illustrated in FIG. 2), a mounting part 40 protruding from the upper part of the main body 38 to the lower left side, and a contact part 41 protruding from the lower part of the main body 38 to the lower right side. Each shaft 39 is rotatably mounted on each guide plate 36 of each guide part 34 of the holder 24 . This allows each guide part 34 to hold each separation claw 25 so that each separation claw 25 is swingable. The contact part 41 is formed in an acute shape. The tip end part of the contact part 41 comes in contact with the outer circumferential face of the fixing roller 21. A coating 42 is applied to the tip end part of the contact part 41.

With reference to FIG. 3, respective separation claws 25 are arranged with intervals in the front-and-rear direction. Each separation claw 25 is movable in the front-and-rear direction and within a movement area MA. The movement areas MA of the two separation claws 25 on the inside in the front-and-rear direction out of the four separation claws 25 are overlapped with the central area 21A of the fixing roller 21 in the front-and-rear direction. The movement areas MA of the two separation claws 25 on the outside in the front-and-rear direction out of the four separation claws 25 are overlapped with the pair of end areas 21B of the fixing roller 21 in the front-and-rear direction.

Figure 4:
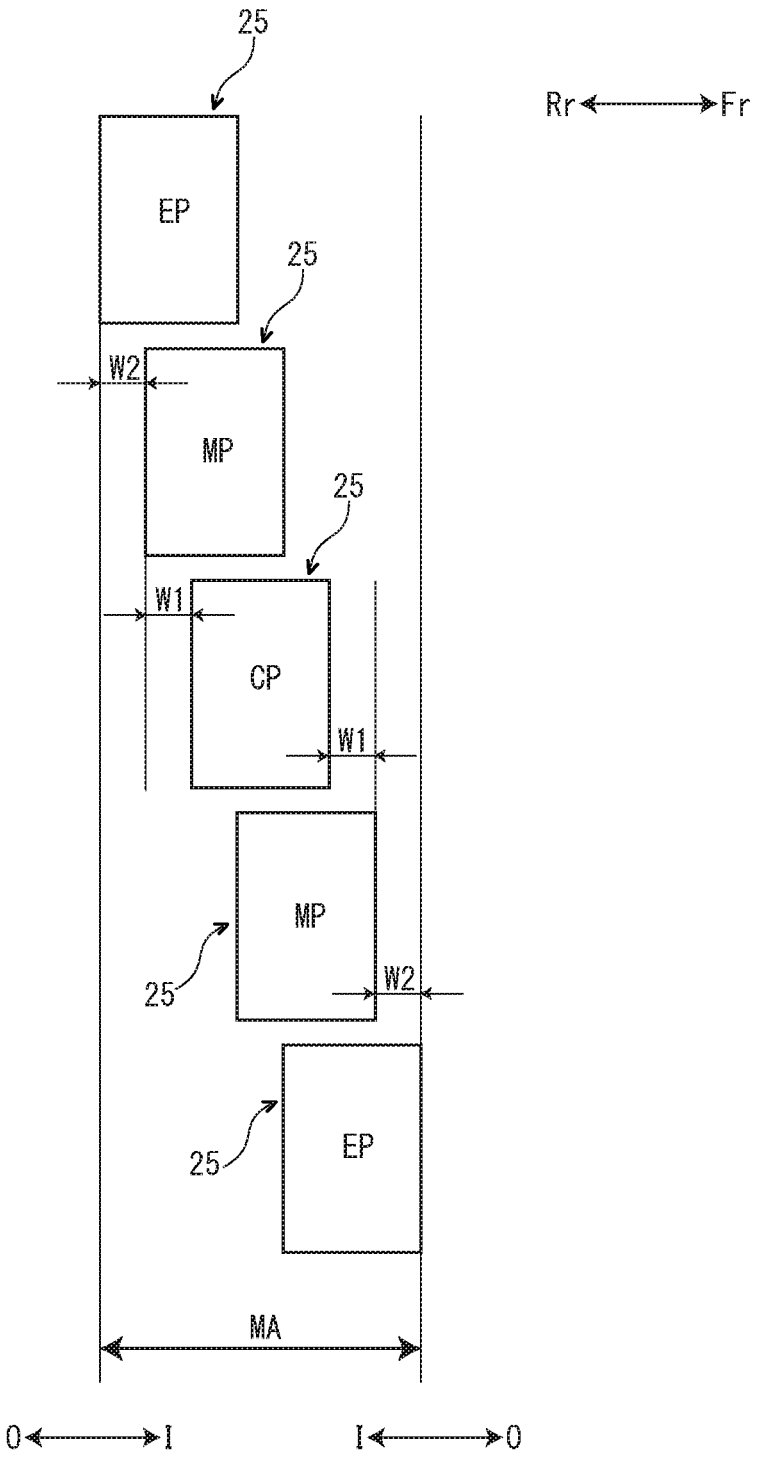
FIG. 4 is a schematic view illustrating positions of each separation claw in the movement area in the fixing device according to the one embodiment of the present disclosure.

With reference to FIG. 4, one central position CP is set in a central part in the front-and-rear direction of the movement area MA of each separation claw 25. Two end positions EP are set in both end parts in the front-and-rear direction of the movement area MA. Two middle positions MP are set in both side parts in the front-and-rear direction of the movement area MA. Each middle position MP is placed between the central position CP and each end position EP. A displacement width W1 in the front-and-rear direction between the central position CP and each middle position MP and a displacement width W2 in the front-and-rear direction between each middle position MP and each end position EP are 1 mm, respectively.

With reference to FIG. 3, the mounting member 26 of the fixing device 12 extends in the front-and-rear direction and is provided in parallel to the base part 32 of the holder 24. The mounting member 26 is movable in the front-and-rear direction. A second rack gear 43 is provided on the right face of the mounting member 26.

With reference to FIG. 2, one end in the axial direction of each tension spring 27 of the fixing device 12 is mounted on the mounting part 40 of each separation claw 25. The other end in the axial direction of each tension spring 27 is mounted on the mounting member 26. Each tension spring 27 generates moment counterclockwise, viewed from the front (see the arrow A in FIG. 2), to each separation claw 25, thereby pressing the tip end part of the contact part 41 of each separation claw 25 against the outer circumferential face of the fixing roller 21.

With reference to FIG. 3, the movement mechanism 28 of the fixing device 12 includes a driving part 44 and a moving part 45 connected to the driving part 44.

The driving part 44 of the movement mechanism 28, for example, is constituted by a motor and is rotatable. The driving part 44 is connected to the fixing roller 21 via a gear train (not illustrated).

The moving part 45 of the movement mechanism 28 includes a cam 48 and a coil spring 49. The cam 48 is rotatable around a cam shaft 48A. A distance from the cam shaft 48A to the outer circumferential face of the cam 48 is successively changed along the circumferential direction. The cam 48 comes in contact with the front face of the bent part 33 of the holder 24 and presses the bent part 33 of the holder 24 to the rear side (one side in the front-and-rear direction). The coil spring 49 comes in contact with the rear face of the bent part 33 of the holder 24 and presses the bent part 33 of the holder 24 to the front side (the other side in the front-and-rear direction).

The pinion gear 29 of the fixing device 12 is rotatable. The pinion gear 29 meshes with the first rack gear 35 provided on the base part 32 of the holder 24 and meshes with the second rack gear 43 provided on the mounting member 26.

Regarding the fixing device 12 having the aforementioned configuration, an operation of fixing a toner image T on the sheet S will be described.

When the toner image T is fixed on the sheet S, the driving part 44 is rotated. Following this, the fixing roller 21 connected to the driving part 44 rotates (see an arrow B in FIG. 2). Following this, the pressing roller 23 coming in contact with the fixing roller 21 rotates in a reverse direction with respect to the rotating direction of the fixing roller 21 (see an arrow C in FIG. 2).

In addition, when the toner image T is fixed on the sheet S, the electric power is supplied to the heater 22, and the fixing roller 21 is heated by the heater 22. When the sheet S passes through the fixing nip N in this state, the sheet S and the toner image T are heated and pressed by the fixing roller 21 and the pressing roller 23, thereby fixing the toner image T on the sheet S. The sheet S on which the toner image T is fixed is separated from the outer circumferential face of the fixing roller 21 by the contact part 41 of each separation claw 25. This prevents the sheet S from being wound around the outer circumferential face of the fixing roller 21.

Incidentally, regarding the fixing device 12 having the aforementioned configuration, when each separation claw 25 continuously comes in contact with the same part of the outer circumferential face of the fixing roller 21, the outer circumferential face of the fixing roller 21 is partially worn away by each separation claw 25, which may lead to partial abrasion of the outer circumferential face of the fixing roller 21. Thus, the partial abrasion of the outer circumferential face of the fixing roller 21 is prevented in the present embodiment as described below.

With reference to FIG. 3, when the driving part 44 rotates during the conveyance of the sheet S, the rotation of the driving part 44 is transmitted to the cam 48 of the moving part 45, which causes the cam 48 to rotate. Thus, when the cam 48 rotates, a position at which the cam 48 presses the bent part 33 of the holder 24 is changed in the front-and-rear direction. Following this, the holder 24 reciprocates in the front-and-rear direction, and each separation claw 25 held by the holder 24 reciprocates integrally with the holder 24 in the front-and-rear direction and within the movement area MA.

As described above, in the present embodiment, the movement mechanism 28 reciprocates each separation claw 25 within the movement area MA. Following this, a contact position of each separation claw 25 with respect to the outer circumferential face of the fixing roller 21 can be changed in the front-and-rear direction, and the partial abrasion of the outer circumferential face of the fixing roller 21 can be prevented.

Next, regarding the fixing device 12 having the aforementioned configuration, a contact time of each separation claw 25 and the fixing roller 21 will be described with reference to FIGS. 5 and 6.

Figure 5:
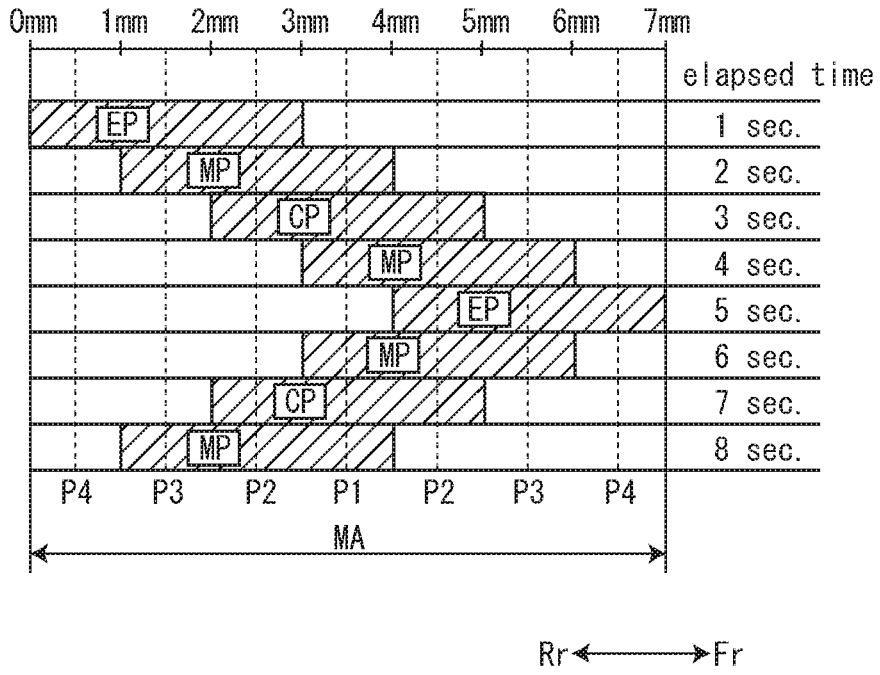
FIG. 5 is a schematic view illustrating a relation of an elapsed time and the positions of each separation claw in the movement area in the fixing device according to the one embodiment of the present disclosure.

In FIG. 5, hatched areas schematically illustrate each separation claw 25. A sign P1 in FIG. 5 indicates a point in the center of the movement area MA in the front-and-rear direction. Hereinafter, this point is referred to as a first contact point P1. Signs P2 in FIG. 5 indicate points deviated by 1 mm from the first contact point P1 on both outer sides in the front-and-rear direction. Hereinafter, these points are referred to as second contact points P2. Signs P3 in FIG. 5 indicate points deviated by 1 mm from respective second contact points P2 on both outer sides in the front-and-rear direction. Hereinafter, these points are referred to as third contact points P3. Signs P4 in FIG. 5 indicate points deviated by 1 mm from respective third contact points P3 on both outer sides in the front-and-rear direction. Hereinafter, these points are referred to as fourth contact points P4.

With reference to FIG. 5, in the fixing device 12 according to the present embodiment, the front-and-rear width of each separation claw 25 is 3 mm, and the front-and-rear width of the movement area MA is 7 mm. Thus, each separation claw 25 can move in 4 mm in the front-and-rear direction and within the movement area MA. Each separation claw 25 successively moves at a speed of 1 mm/sec in the front-and-rear direction.

With reference to FIG. 6, when a time required for each separation claw 25 to reciprocate once within the movement area MA is regarded as one cycle, the contact times of each separation claw 25 and the fixing roller 21 for every one cycle (8 seconds) at respective contact points P1 to P4 (hereinafter, merely referred to as "contact time") are 6 seconds, 5 seconds, 3 seconds, and 1 second, respectively. When a target time (5000 seconds=8 seconds×625 cycles) elapses, the contact times at the contact points P1 to P4 are 3750 seconds, 3125 seconds, 1875 seconds, and 625 seconds, respectively. Thus, the ratios of the contact times at the contact points P1 to P4 to the maximum contact time (the contact time at the first contact point P1) are 100%, 83%, 50%, and 17%, respectively.

As described above, in the fixing device 12 according to the present embodiment, large deviation occurs in the contact times at the contact points P1 to P4. Specifically a difference between the contact time at the first contact point P1 (a point in the center of the movement area MA in the front-and-rear direction) and the contact time at each fourth contact point P4 (each point on the end side of the movement area MA in the front-and-rear direction) is exceedingly large. Consequently, large deviation occurs in the amount of abrasion (depth of abrasion) of the fixing roller 21, and the maximum amount of abrasion of the fixing roller 21 in the center of the movement area MA in the front-and-rear direction reaches an allowable limit of the amount of abrasion of the fixing roller 21 at an early stage, which may shorten the life span of the fixing roller 21. Thus, in the present embodiment, the amount of abrasion of the fixing roller 21 is uniformed as described below.

FIG. 3 indicates a state in which each separation claw 25 is located at the central position CP in the movement area MA. In this state, the length of each tension spring 27 is L1, and accordingly the pressing load of each separation claw 25 against the fixing roller 21 is Z1.

Figure 7:
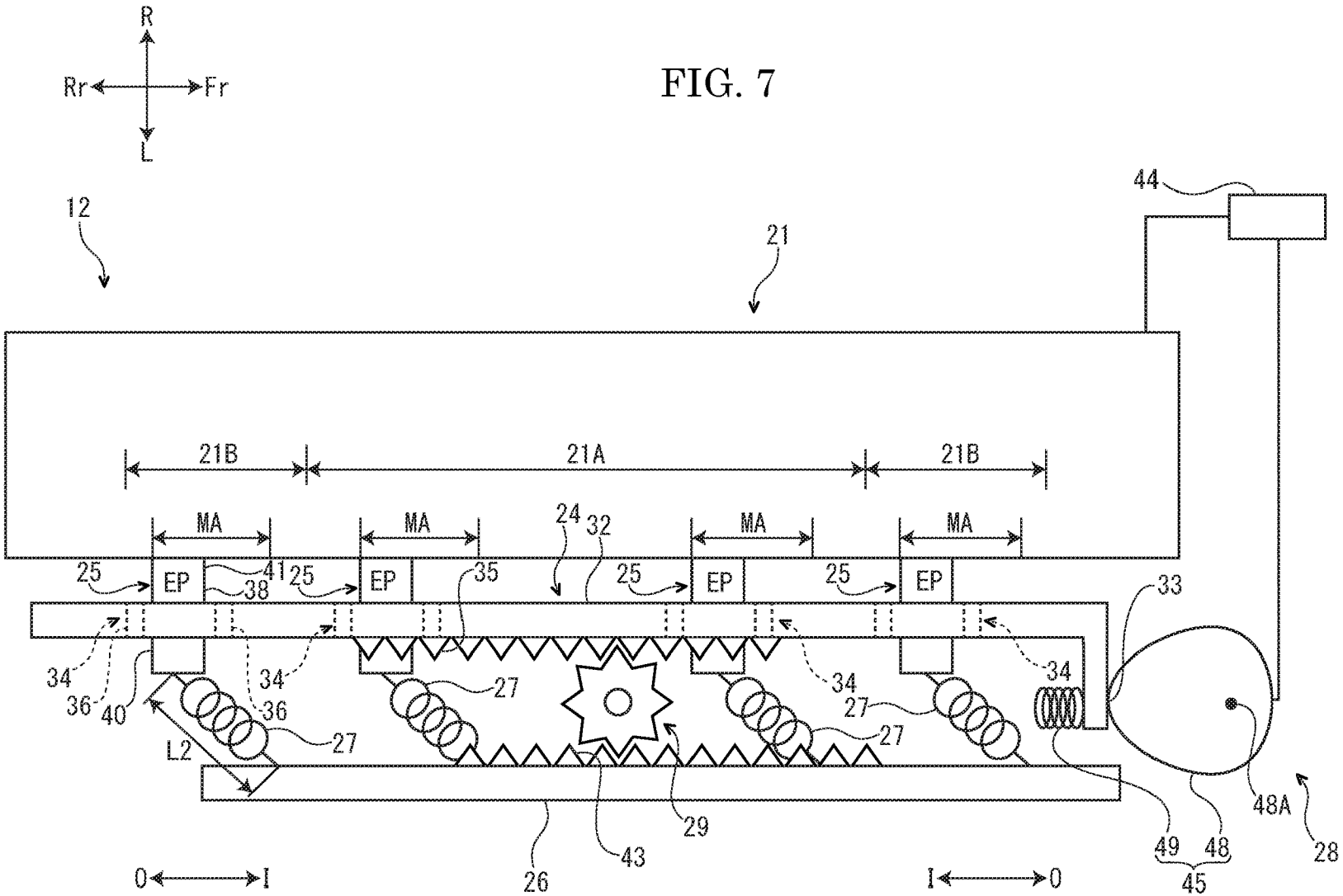
FIG. 7 is a plan view illustrating a state in which each separation claw is located at an end position on a rear side of the movement area in the fixing device according to the one embodiment of the present disclosure.

Thus, when the cam 48 rotates in one direction from the state in which each separation claw 25 is located at the central position CP in the movement area MA, a position at which the cam 48 presses the holder 24 is changed to the rear side. According to this, as illustrated in FIG. 7, the holder 24 moves to the rear side (one side in the front-and-rear direction), and each separation claw 25 held by the holder 24 moves from the central position CP in the movement area MA to the end position EP on the rear side.

When the holder 24 moves to the rear side (one side in the front-and-rear direction) as described above, the mounting member 26 connected to the holder 24 via the pinion gear 29 moves to the front side (the other side in the front-and-rear direction). This causes the length of each tension spring 27 interposed between each separation claw 25 and the mounting member 26 to change from L1 to L2 (L2>L1). Following this, the moment (see the arrow A in FIG. 2) generated by each tension spring 27 is increased, which causes the pressing load of each separation claw 25 against the fixing roller 21 to change from Z1 to Z2 (Z2>Z1).

Thus, when the cam 48 further rotates in the one direction from the state in which each separation claw 25 is located at the end position EP on the rear side of the movement area MA, the position at which the cam 48 presses the holder 24 is changed to the front side. Following this, the holder 24 moves to the front side (the other side in the front-and-rear direction), and each separation claw 25 held by the holder 24 moves from the end position EP on the rear side of the movement area MA to the central position CP. Following this, the length of each tension spring 27 is restored from L2 to L1, and the pressing load of each separation claw 25 against the fixing roller 21 is restored from Z2 to Z1.

Figure 8:
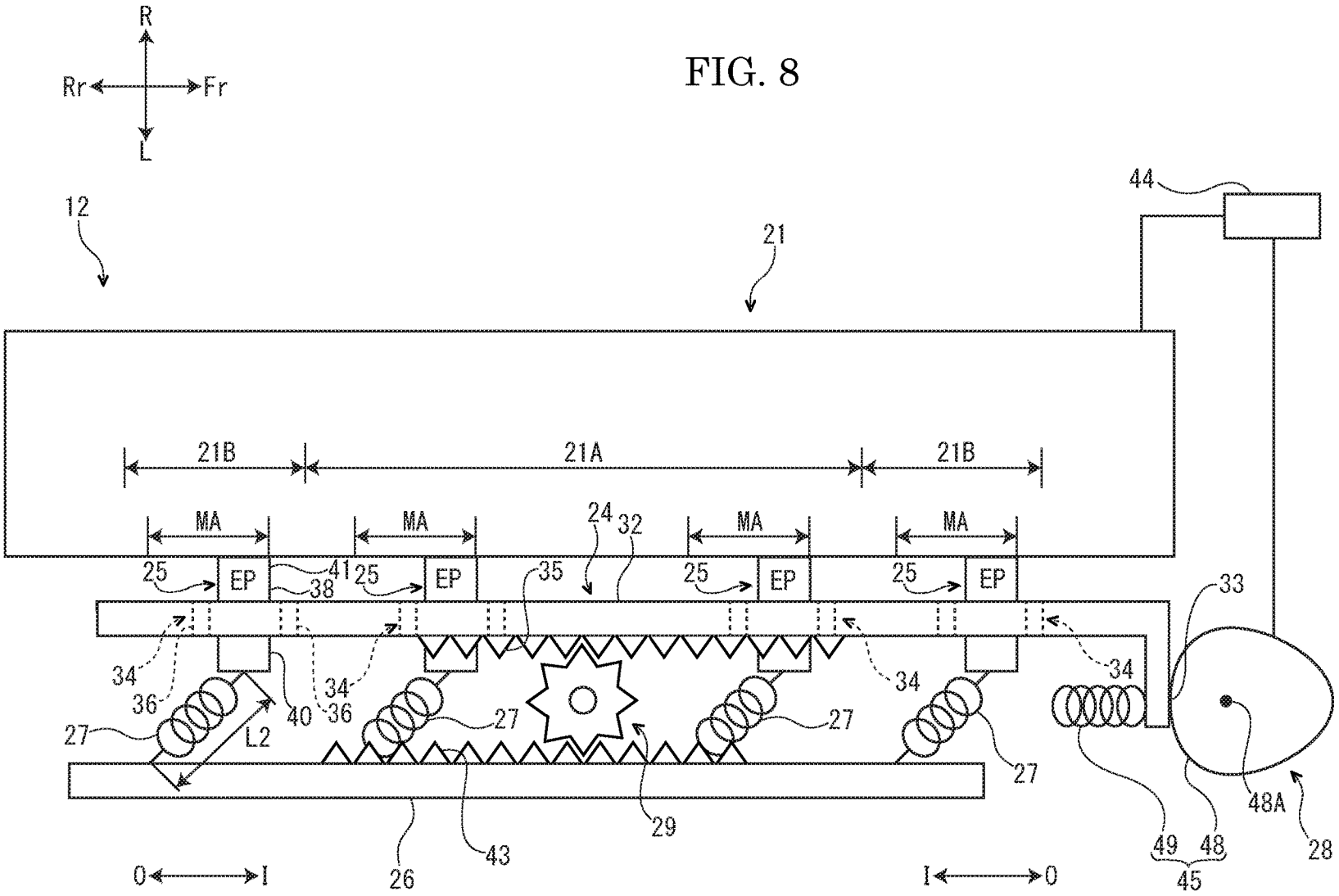
FIG. 8 is a plan view illustrating a state in which each separation claw is located at an end position on a front side of the movement area in the fixing device according to the one embodiment of the present disclosure.

Thus, when the cam 48 further rotates in the one direction from the state in which each separation claw 25 is located at the central position CP in the movement area MA, the position at which the cam 48 presses the holder 24 is changed to the front side. Following this, as illustrated in FIG. 8, the holder 24 moves to the front side (the other side in the front-and-rear direction), and each separation claw 25 held by the holder 24 moves from the central position CP in the movement area MA to the end position EP on the front side.

When the holder 24 moves to the front side (the other side in the front-and-rear direction) as described above, the mounting member 26 connected to the holder 24 via the pinion gear 29 moves to the rear side (one side in the front-and-rear direction). This causes the length of each tension spring 27 interposed between each separation claw 25 and the mounting member 26 to change from L1 to L2 (L2>L1). Following this, the moment (see the arrow A in FIG. 2) generated by each tension spring 27 is increased, which causes the pressing load of each separation claw 25 against the fixing roller 21 to change from Z1 to Z2 (Z2>Z1).

Thus, when the cam 48 further rotates in the one direction from the state in which each separation claw 25 is located at the end position EP on the front side of the movement area MA, the position at which the cam 48 presses the holder 24 is changed to the rear side. Following this, the holder 24 moves to the rear side (one side in the front-and-rear direction), and each separation claw 25 held by the holder 24 moves from the end position EP on the front side of the movement area MA to the central position CP. Following this, the length of each tension spring 27 is restored from L2 to L1, and the pressing load of each separation claw 25 against the fixing roller 21 is restored from Z2 to Z1.

As described above, in the fixing device 12 according to the present embodiment, the pressing load Z1 of each separation claw 25 against the fixing roller 21 in a case where each separation claw 25 is located at the central position CP of the movement area MA is lower than the pressing load Z2 of each separation claw 25 against the fixing roller 21 in a case where each separation claw 25 is located at both end positions EP of the movement area MA. Consequently, the abrasion of the fixing roller 21 at the central position CP of the movement area MA can be prevented. Following this, the amount of abrasion (depth of abrasion) of the fixing roller 21 can be uniformed, and a time for which the maximum amount of abrasion of the fixing roller 21 reaches an allowable limit of the amount of abrasion of the fixing roller 21 can be prolonged, and a long life span of the fixing roller 21 can be achieved.

In addition, the movement mechanism 28 includes the rotatable driving part 44 and the moving part 45 that is connected to the driving part 44 and moves the holder 24 in the front-and-rear direction as the driving part 44 rotates. By applying such a configuration, each separation claw 25 can be moved in the front-and-rear direction by a simple configuration.

When the holder 24 moves to the rear side (one side in the front-and-rear direction), the mounting member 26 moves to the front side (the other side in the front-and-rear direction), and the length of each tension spring 27 is changed, and the pressing load of each separation claw 25 against the fixing roller 21 is changed. By applying such a configuration, the pressing load of each separation claw 25 against the fixing roller 21 is changed by a simple configuration.

The first rack gear 35 that meshes with the pinion gear 29 is provided on the holder 24, and the second rack gear 43 that meshes with the pinion gear 29 is provided on the mounting member 26. By applying such a configuration, the mounting member 26 can be moved by a large amount in an opposite direction with respect to the movement direction of the holder 24 by using a rack-and-pinion mechanism. Following this, the pressing load of each separation claw 25 against the fixing roller 21 can be changed by a large amount.

Further, the fixing roller 21 is connected to the driving part 44 and rotates as the driving part 44 rotates. By applying such a configuration, it is possible to move each separation claw 25 in the front-and-rear direction and to rotate the fixing roller 21 by using the single driving part 44, thereby preventing the complication of the configuration of the fixing device 12.

The image forming apparatus 1 includes the fixing device 12 that can achieve a long life span of the fixing roller 21. Consequently, a long life span of the image forming apparatus 1 can be achieved.

In the present embodiment, each separation claw 25 is moved in the front-and-rear direction and the fixing roller 21 is rotated by using the single driving part 44. On the other hand, in another embodiment, a driving part for moving each separation claw 25 in the front-and-rear direction and a driving part for rotating the fixing roller 21 may be separately provided.

In the present embodiment, the tip end part of the contact part 41 of each separation claw 25 is pressed against the outer circumferential face of the fixing roller 21 by using each tension spring 27. On the other hand, in another embodiment, the tip end part of the contact part 41 of each separation claw 25 may be pressed against the outer circumferential face of the fixing roller 21 by using a pressing member such as a torsion spring except for the tension spring 27.

In the present embodiment, the moving part 45 includes the cam 48 and the coil spring 49. On the other hand, in another embodiment, the moving part 45 may include a mechanism (e.g., the rack-and-pinion mechanism) except for the cam 48 and the coil spring 49. That is, any mechanism may be provided for the moving part 45 as long as each separation claw 25 can be moved in the front-and-rear direction.

In the present embodiment, the fixing roller 21 constitutes the fixing member. On the other hand, in another embodiment, the fixing belt may constitute the fixing member.

In the present embodiment, the image forming apparatus 1 is a printer. On the other hand, in another embodiment, the image forming apparatus 1 maybe a copying machine, a facsimile, or a multifunctional peripheral (an image forming apparatus which has multiple functions like a print function, a copy function, and a facsimile function), or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing member to rotate around a rotation axis extended in a rotation axis direction and fix a toner image on a recording medium;

a separation member to come in contact with the fixing member and separate the recording medium from the fixing member;

a movement mechanism to move the separation member in the rotation axis direction and within a movement area; and a pressing member to press the separation member against the fixing member, wherein a pressing load of the separation member against the fixing member in a case where the separation member is located at a central position of the movement area is lower than a pressing load of the separation member against the fixing member in a case where the separation member is located at both end positions of the movement area.

2. The fixing device according to claim 1, further comprising a holder to hold the separation member so that the separation member is swingable, wherein the movement mechanism includes:

a rotatable driving part; and a moving part to be connected to the driving part and to move the holder in the rotation axis direction as the driving part rotates.

3. The fixing device according to claim 2, further comprising a mounting member to be movable in the rotation axis direction, wherein the pressing member is a tension spring interposed between the separation member and the mounting member, and when the holder moves to one side in the rotation axis direction, the mounting member moves to another side in the rotation axis direction, and a length of the tension spring is changed, so that the pressing load of the separation member against the fixing member is changed.

4. The fixing device according to claim 3, further comprising a pinion gear to be arranged between the holder and the mounting member, wherein a first rack gear to mesh with the pinion gear is provided on the holder, and a second rack gear to mesh with the pinion gear is provided on the mounting member.

5. The fixing device according to claim 2, wherein the fixing member is connected to the driving part and rotates as the driving part rotates.

6. The fixing device according to claim 2, wherein the moving part includes a cam to press the holder.

7. The fixing device according to claim 6, wherein the holder includes:

a base part to be extended along the rotation axis direction; and a bent part to be bent from one end part in the rotation axis direction of the base part, and the cam comes in contact with the bent part.

8. An image forming apparatus comprising:

the fixing device according to claim 1.

* * * * *